US007892019B2

(12) United States Patent
Rao et al.

(10) Patent No.: US 7,892,019 B2
(45) Date of Patent: Feb. 22, 2011

(54) SAS PANEL MOUNT CONNECTOR CABLE ASSEMBLY WITH LEDS AND A SYSTEM INCLUDING THE SAME

(75) Inventors: Deepak Rao, Fremont, CA (US); Alan L. Winick, Meadow Vista, CA (US); Gurpreet S. Dayal, Fremont, CA (US)

(73) Assignee: Oracle America, Inc., Redwood City, CA (US)

( * ) Notice: Subject to any disclaimer, the term of this patent is extended or adjusted under 35 U.S.C. 154(b) by 97 days.

(21) Appl. No.: 12/265,517

(22) Filed: Nov. 5, 2008

(65) Prior Publication Data

US 2010/0112850 A1 May 6, 2010

(51) Int. Cl.
*H01R 12/24* (2006.01)

(52) U.S. Cl. ..... 439/492

(58) Field of Classification Search ..... 439/492, 439/490, 502, 626, 637, 638
See application file for complete search history.

(56) References Cited

U.S. PATENT DOCUMENTS 6,657,548 B2 * 12/2003 Dai ..... 340/815.45
6,743,054 B2 * 6/2004 Wu ..... 439/638
7,247,046 B1 * 7/2007 Wu ..... 439/490
2001/0046813 A1 * 11/2001 Greenside et al. ..... 439/625
2004/0233563 A1 * 11/2004 Wada et al. ..... 360/39
2005/0272303 A1 * 12/2005 Wu ..... 439/499
2006/0105597 A1 * 5/2006 Purwin ..... 439/79

* cited by examiner

*Primary Examiner*—Alexander Gilman
(74) *Attorney, Agent, or Firm*—Osha Liang LLP

(57) ABSTRACT

A SAS panel mount cable assembly for providing access of target hard-drive resources to an initiator-host includes an initiator-side connector, two target-side connectors, and a wire-harness. Each of the two target-side connectors includes a power-link portion, a signal-link portion, an interface separating the power-link portion and the signal-link portion, and a plurality of LEDs for indicating activity and fault-detection. A plurality of power-wires electrically connects the wire-harness to the power-link portions of the two target-side connectors, and two signal-link cables connect the initiator-side connector to the signal-link portions of the two target-side connectors.

19 Claims, 4 Drawing Sheets

| CONN. 3 | WIRE COLOR | PIN DEFINE | CONN. 4 |
|---|---|---|---|
| P1 | YELLOW 20AWG | V12 | C-P15 |
| | | V12 | C-P14 |
| P2 | YELLOW 26AWG | V12, Precharge | C-P13 |
| P3 | BLACK 26AWG | GROUND | C-P12 |
| P4 | BLACK 26AWG | READY LED | C-P11 |
| P5 | BLACK 26AWG | PRESENT | C-P10 |
| P6 | RED 20AWG | V5 | C-P9 |
| | | V5 | C-P8 |
| P7 | RED 26AWG | V12, Precharge | C-P7 |
| P8 | BLACK 20AWG | GROUND | C-P6 |
| | | GROUND | C-P5 |
| | | GROUND | C-P4 |
| N/C | | C-P1~C-P3 | |

*FIG. 6*

SAS PANEL MOUNT CONNECTOR CABLE ASSEMBLY WITH LEDS AND A SYSTEM INCLUDING THE SAME

BACKGROUND OF INVENTION

1. Field of the Invention

The invention relates generally to a Serial Attached Small Computer System Interface (SAS) cable assembly with LEDs suitable for panel mounting. More specifically, this invention relates to a SAS panel mount connector cable assembly for providing access to resources of a plurality of target hard-drives to multiple hosts, where LEDs are used for activity and fault-detection.

2. Background Art

Increased demand for bandwidth and storage requirements in computer networks have recently led to the widespread employment of SAS drives for data management at Information Technology (IT) centers. SAS offers the advantages of the speed and size improvements in Very Large Scale Integration (VLSI) technology, coupled with the reliability of parallel Small Computer System Interface (SCSI). Expanders in SAS also allow for support of $2^{14}$ or 16384 devices, and thereby, multiple hosts and targets may be linked.

Another major advantage of SAS is that it is backward compatible with Serial Advanced Technology Attachment (SATA) buses, which renders the possibility of hybrid cable connector assemblies suited to both SAS and SATA drives. With the successful employment of cable assemblies, the need also arises to provide continued target-drive access to multiple hosts. This renders dual-port target drives necessary, as availability and redundancy is increased. The redundancy also increases the fault tolerance of a computer system employing a dual-port connector assembly.

SAS and SATA connectors differ only in that SATA connectors offer only one physical-link (signal-link) connection while SAS may offer two. Therefore, both the SAS and SATA connectors look similar, expect that in the SAS connector the power-link and physical-link portions are separated by an interface that may accommodate a secondary physical-link. Thus, SAS connectors offer the possibility of two-port connections in the same connector, and are backward compatible with SATA connectors.

SUMMARY OF INVENTION

In general, in one aspect, the invention relates to a SAS cable assembly for providing access of target hard-drive resources to an initiator-host. The cable assembly includes an initiator-side connector, two target-side connectors, and a wire-harness. Each of the two target-side connectors may include a power-link portion, a signal-link portion, an interface separating the power-link portion and the signal-link portion, and a plurality of LEDs for indicating activity and fault-detection. A plurality of power-wires electrically connects the wire-harness to the power-link portions of the two target-side connectors, and two signal-link cables connect the initiator-side connector to the signal-link portions of the two target-side connectors.

In one aspect of the invention, fault and activity detection are accomplished through LED control via provision of side-band signals.

In another aspect of the invention, the cable assembly may render a system employing the cable assembly suitable for panel mounting.

Other aspects and advantages of the invention will be apparent from the following description and the appended claims.

BRIEF DESCRIPTION OF DRAWINGS

FIG. 6 is a power-wire connecting diagram in accordance with one or more embodiments of the invention.

DETAILED DESCRIPTION

Figure 1:
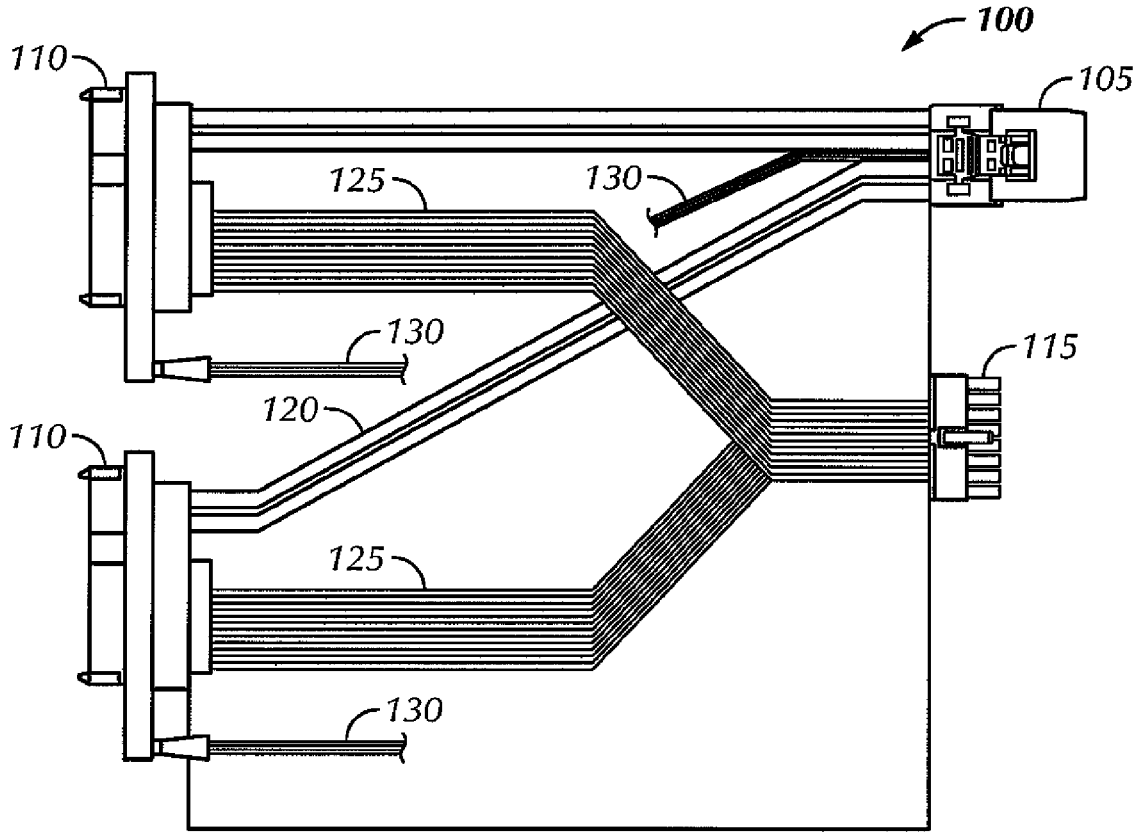
FIG. 1 shows a SAS cable assembly in accordance with one or more embodiments of the invention.

Specific embodiments of the invention will now be described in detail with reference to the accompanying figures. Like elements in the various figures are denoted by like reference numerals for consistency.

In the following detailed description of embodiments of the invention, numerous specific details are set forth in order to provide a more thorough understanding of the invention. However, it will be apparent to one of ordinary skill in the art that the invention may be practiced without these specific details. In other instances, well-known features have not been described in detail to avoid unnecessarily complicating the description.

In general, embodiments of the present invention describe a cable assembly employing a single initiator (or expander) to provide access of target hard drive resources to multiple hosts and/or Host Bus Adaptors (HBAs), where the connector on the initiator side is a mini-SAS that has provisions to be cabled to two target-side connectors that individually may provide access to a hard drive. The connection status may be determined by a plurality of Light Emitting Diodes (LEDs). In one or more embodiments, the cable assembly may include two shielded parallel pair cables with a size 26 according to the American Wire Gauge (AWG) standard, and a differential impedance of 100±10 ohms. In one or more embodiments, the cable size may be 28 or 30 according to the AWG standard. The cable assembly may also be compliant with the Restriction of Hazardous Substances (RoHS) directive standards. In one embodiment, a testing specification for a high potential (Hi-Pot) test may be 300 volts direct current (DC) for 10 milliseconds (ms). For a continuity test, the specification may include an insulation resistance of 10 megaohms and a contact resistance of 3 ohms for the cable assembly excluding the testing fixture. One or more embodiments of the invention renders an information transfer system using the cable assembly to be panel mountable. It is obvious to one of ordinary skill in the art that the cable size specification, differential impedance, testing specification etc. merely serve as examples and, as such, modification of said parameters does not depart from the scope of the invention.

FIG. 1 shows a cable assembly 100 in accordance with one or more embodiments of the invention. The assembly 100 includes an initiator-side connector 105, two target side connectors 110, a wire harness section 115 for providing power wire connections to the target-side connectors 110, SAS signal cables 120 without jackets between the initiator-side connector 105 and the physical link portions of the target-side connectors 110, and power wires 125 between the wire harness section 115 and the power link portions of the target-side connectors 110 (see also FIGS. 2-3). Additionally, the cable assembly 100 may also include flat cables 130 between the initiator-side connector 105 and the target-side connectors 110 for initiating control signals for controlling operation of the LEDs (not shown). In FIG. 1, the flat cables 130 are shown to be discontinuous in order to clearly demarcate the other wire connections. The SAS signal cables 120 may carry no power, and the assembly may be compactly designed for panel mounting suitability.

Figure 2:
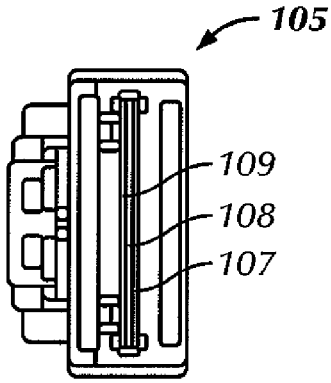
FIG. 2 is a front view of an initiator-side connector in accordance with one or more embodiments of the invention.

FIG. 2 is a front view of an initiator-side connector 105 in accordance with one or more embodiments of the invention. The initiator-side connector 105 may include a plurality of pin connections (36, for example, i.e., A1-A18, and B1-B18) with typically seven pins allocated to link to signal-link pins of the target-side connectors 110. In one embodiment, two sets of seven pins each may be allotted for connection to the target-side connectors 110, with two more sets of seven pins allotted for control of LEDs therein. One set of eight pins are allotted for Serial General Purpose Input/Output (SGPIO) sideband signals for LED control. The initiator-side connector 105 may be configured to mate with a HBA (not shown), for example, for providing access of the target hard-drive resources.

In an example mini-SAS initiator-side connector 105 shown in FIG. 2, a dividing barrier 108 that separates two sets of pins (here A1-A18, and B1-B18) may be present. The barrier 108 may comprise complementary protrusions and depressions on either side (107, 109) for forming a mating connection with the HBA via complementary depressions and protrusions on a corresponding receiving portion of the HBA. It is obvious to one of ordinary skill in the art that any of the sets of seven pins may be employed in combination with another set for connection to the target-side connectors 110. The initiator-side connector 105 may have enough pins to connect to four hard-drives, two on each individual target-side connector 110. Additionally, the number of pins allotted for side-band signals should not be considered limiting as LED control is vendor-specific.

Figure 3:
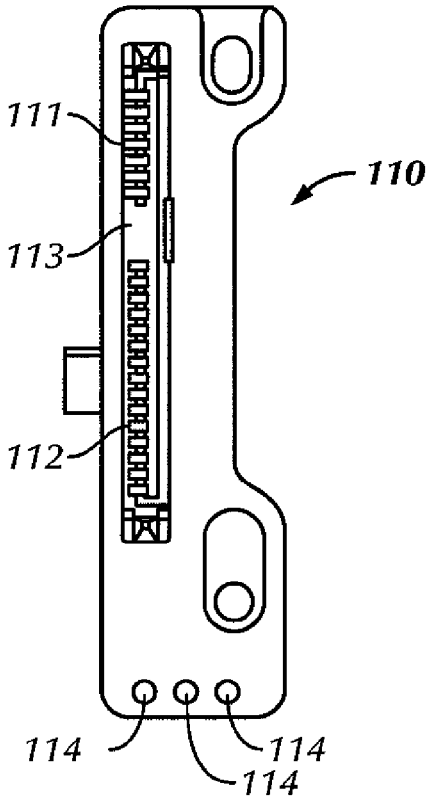
FIG. 3 is a front view of a target-side connector in accordance with one or more embodiments of the invention.

FIG. 3 is a front view of a target-side connector 110 in accordance with one or more embodiments of the invention. The target-side connector 110 includes two portions, one of which may receive the power connections from the wire harness section 115, and the other the connections from the initiator-side connector 105. FIG. 3 shows the side that is connected to a target hard-drive (not shown), where the power connection slot 111 and the signal-link slot 112 are separated by an interface 113. In one or more embodiments, the interface 113 may be removable and may support a secondary physical link (not shown). In one embodiment, the power connection slot 111 may include 15 pins, and the signal-link slot 112 may include seven pins. Three LEDs 114 having green, amber, and blue light colors may also be employed to indicate hard-drive connection status. Control of LEDs may be specific to a vendor. Those skilled in the art will appreciate that the number of pins in the power connection slot 111, LED light colors, number of LEDs etc. may be varied without departing from the spirit of the invention.

Figure 4:
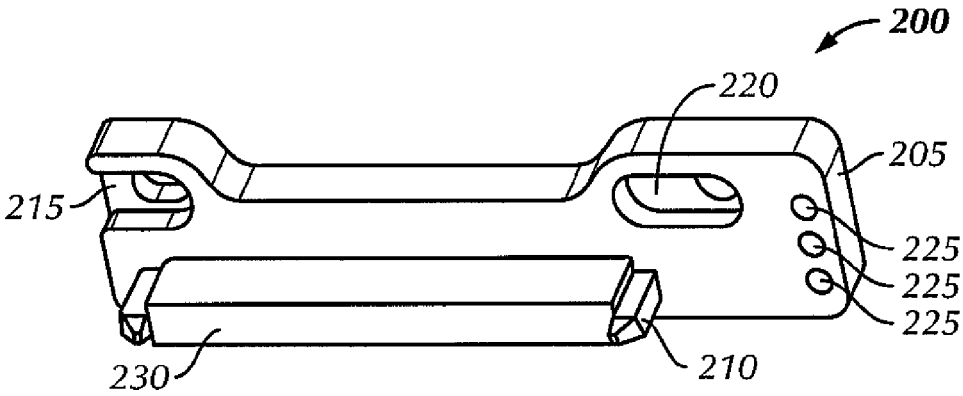
FIG. 4 is a perspective view of a target-side connector in accordance with one or more embodiments of the invention.

FIG. 4 is a perspective view of a target-side connector 200 in accordance with one or more embodiments of the invention. The target-side connector 200 includes a body-portion 205, perpendicular to which the housing 210 that comprises the power-link and the signal-link slots protrudes. The housing 210 is configured to accommodate a portion of a target-hard drive (not shown). There are two slots on the sides of the body-portion 205, viz. 215 and 220, for connection purposes. At the back of the body-portion 205, i.e., on the other side of the slot 220, a flat cable 130 connects the initiator-side connector to the target-side connector. The LEDs 225 are located on a lateral end of the body-portion 205. FIG. 4 also shows the housing 210 covered by a cap 230 for protection purposes. Again, it is obvious to one of ordinary skill in the art that the position of LEDs, slots, housing etc. are not to be considered limiting, as is the presence of the cap. The invention may be practiced with differing positions of constituent elements of the target-side connector.

Figure 5:
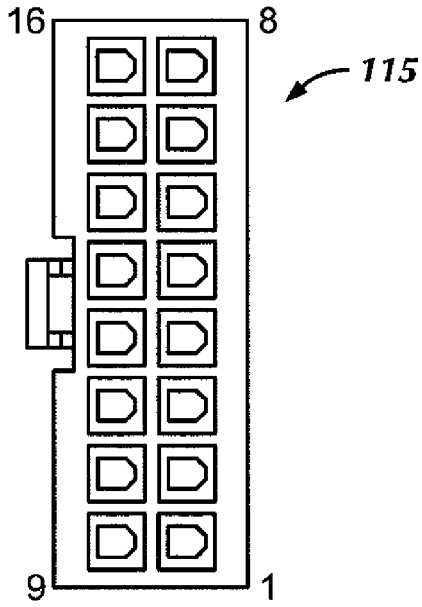

FIG. 5 is a front view of the wire harness 115 in accordance with one or more embodiments of the invention, and FIG. 6 is an example power wire connecting diagram for connecting power wires 125 between the wire harness 115 and a target-side connector 110 in accordance with the aforementioned embodiment. In the exemplary embodiment shown, the wire harness 115 includes slots for 16 pins, labeled P1-P16, to be electrically connected to the target-side connector 110, whose power-connection pins are labeled C,P1-C,P15. As the power wire connecting diagram for the two target-side connectors 110 are similar, FIG. 6 shows the power wire connecting diagram for one target connector 110 (CONN. 4) alone, using pins P1-P8 of the wire harness 115 (CONN. 3). Two standard voltages 12V and 5V for SAS and SATA drives may be used, with a pre-charge pin allotted for each one of them. A resistor may be connected between the voltage supply used and the pre-charge pin to prevent excess current flow into the drives during connection.

Thus, four power-connection pins on the target-connector 110 may be allotted for each of the 12V and 5V sources, a positive, a negative, ground and a pre-charge. One pin may be allotted for sensing the PRESENT status of the drives, one pin allotted for a READY LED to indicate that the target drive is ready to be accessed, and pin/pin(s) for the corresponding ground connections. Three of the target connector 110 pins may be left unused. The same pin-slots may be used in the wire harness 115 to connect to different pins in the target-side connector 110 as shown in FIG. 6 in the case of the 12V and 5V supplies and the ground connections. The colors of wires and AWG sizes used are also indicated in FIG. 6. It is obvious to one of ordinary skill in the art that the pin assignments may be done in any order, and the number of pins may be varied. FIG. 6 merely shows one example of a power wire diagram that may be employed in one or more embodiments of the invention. Those skilled in the art will appreciate that the specific wiring may be changed depending on the particular system being used.

Figure 7:
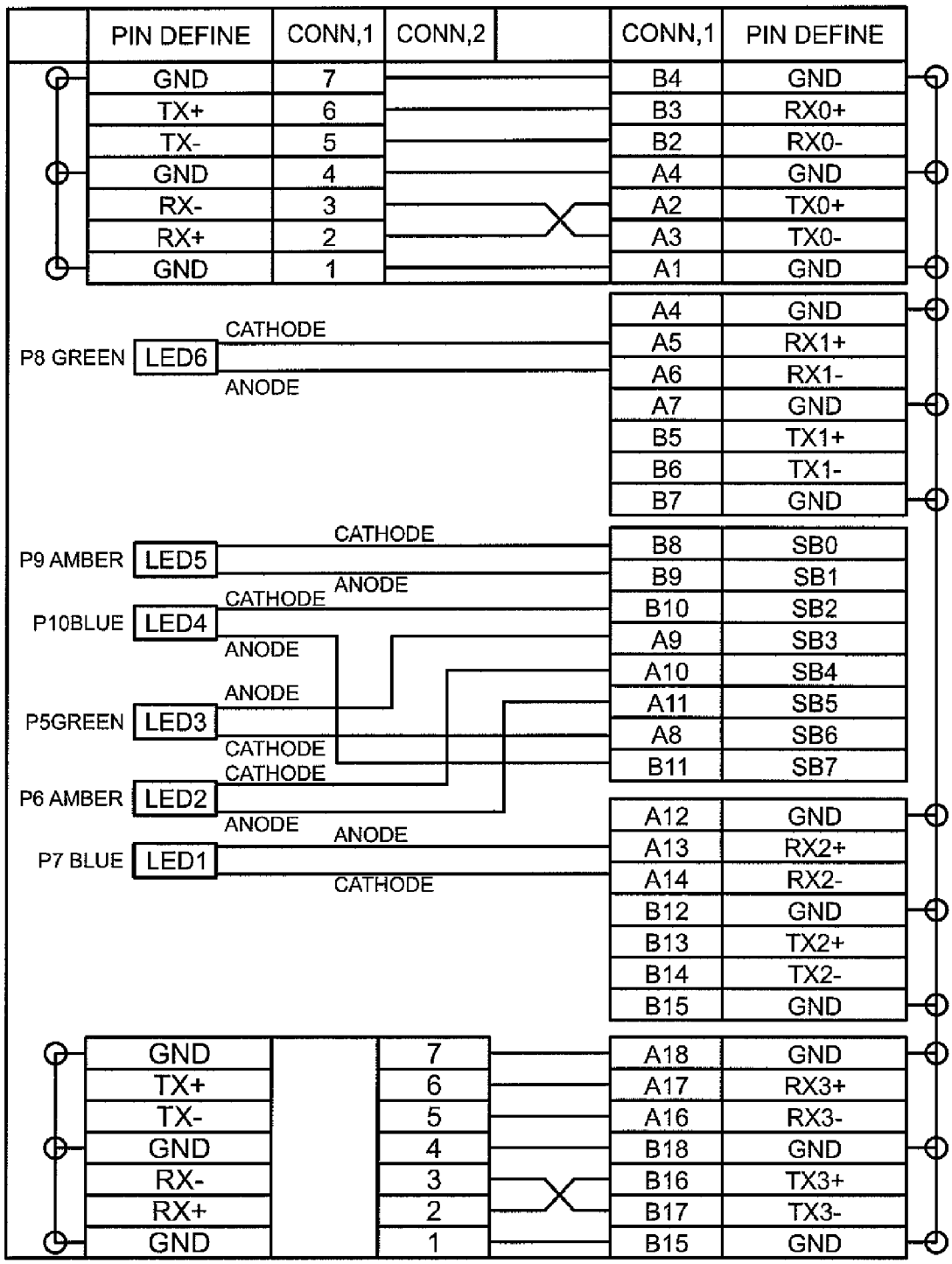
FIG. 7 is a signal wiring diagram in accordance with one or more embodiments of the invention.

FIG. 7 is an example signal wiring diagram showing the signal-link connections between the initiator-side connector 105 and the target-side connectors 110. As described above with reference to FIG. 2, any set of initiator-side connector 105 (CONN. 1) pins may be employed to connect to the signal-link pins of the target-side connectors 110 (CONN. 2 and CONN. 4). FIG. 7 shows the assignment of two transmit (TX+, TX−), two receive (RX+, RX−), and three ground pins each on one target-side connector 110 and the initiator-side connector 105. The four possible sets of seven pins are each assigned with indices 0-3.

Additionally, LED management may be accomplished by allotting a set of eight pins on the initiator-side connector 105 for sideband signals (SB0-SB7). These pins are connected to LEDs as shown in FIG. 7. LEDs are also connected to receive pins of non-allotted sets on the initiator-side connector 105. LED management and sideband signal allotment may vary, for instance, based on vendor requirements.

As an example, a green LED (refer to P8 in FIG. 7) on one of the target connectors 110 connected to receive pins on the initiator-side connector 105 may be an activity LED, and the corresponding amber and blue LEDs (P9 and P10) connected to the sideband signal pins on the initiator-side connector 105 may be fault-indicator LEDs. The LEDs may steadily emit light, flash regularly, irregularly, turn off, etc. to aid in effective management. For example, the green LED ON and the amber and blue LEDs OFF may indicate that the drive is connected but not currently active. The green LED ON, OFF, or flashing, and the blue LED ON may indicate that the drive has failed. The green LED and the amber LED flashing in conjunction with regularity may indicate that it is imperative to replace the drive immediately. All the LEDs being OFF may indicate that the drive is not online. The green LED flashing and the other LEDs OFF may indicate normal operation. More combinations may be devised for effective connection and system management. The aforementioned indicators serve merely as example management techniques and, as such, may be devised in various other forms.

While the invention has been described with respect to an exemplary embodiment of a SAS cable assembly, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A SAS cable assembly for providing access of target hard-drive resources to an initiator-host, the SAS cable assembly comprising:

an initiator-side connector;

two target-side connectors each comprising:

a power-link portion;

a signal-link portion;

an interface separating the power-link portion and the signal-link portion; and a plurality of LEDs for indicating activity and fault-detection;

a wire-harness;

a plurality of power-wires electrically connecting the wire-harness to the power-link portions of the two target-side connectors; and two signal-link cables connecting the initiator-side connector to the signal-link portions of the two target-side connectors.

2. The SAS cable assembly of claim 1, wherein the assembly further comprises two flat cables connecting the initiator-side connector to the plurality of LEDs on each of the two target-side connectors.

3. The SAS cable assembly of claim 2, wherein the assembly comprises two shielded parallel pairs.

4. The SAS cable assembly of claim 3, wherein a differential impedance of the parallel pairs is 100±10 ohms.

5. The SAS cable assembly of claim 4, wherein a size of the parallel pairs is one of 26, 28 and 30 according to American Wire Gauge (AWG) standard.

6. The SAS cable assembly of claim 1, wherein the initiator-side connector is a mini-SAS connector.

7. The SAS cable assembly of claim 1, wherein the signal-link portion of the target-side connector comprises seven pins.

8. The SAS cable assembly of claim 1, wherein the initiator-side connector has at least a number of pins corresponding to four target hard-drives.

9. The SAS cable assembly of claim 2, wherein a plurality of pins on the initiator-side connector is used for a sideband signal LED control.

10. The SAS cable assembly of claim 2, wherein each of the target-side connectors comprises three LEDs.

11. The SAS cable assembly of claim 2, wherein a target-side connector is configured to connect to a SAS hard-drive.

12. The SAS cable assembly of claim 2, wherein a target-side connector is configured to connect to a SATA hard-drive.

13. The SAS cable assembly of claim 1, wherein the initiator-side connector is configured to connect to a host-bus adapter (HBA).

14. The SAS cable assembly of claim 1, wherein a target-side connector is configured to connect to a backplane of a hard-drive.

15. The SAS cable assembly of claim 1, wherein the target-side connector comprises a cap to cover the power-link, signal-link, and the interface portions for protection purposes in a state of non-connection.

16. The SAS cable assembly of claim 1, wherein the cable assembly is part of a panel mounting.

17. An information transfer system for providing access to target hard-drive resources comprising:

at least one host computer system comprising a host-bus adapter (HBA);

at least two target hard-drives comprising data to be accessed by the at least one host computer system; and at least one SAS cable assembly to provide access of target hard-drive resources to the at least one host computer system, the cable assembly comprising:

a host-side connector configured to connect to the HBA of the at least one host computer system;

two target-side connectors each configured to connect to one target hard-drive, each target-side connector comprising:

a power-link portion;

a signal-link portion;

an interface separating the power-link portion and the signal-link portion; and a plurality of LEDs for indicating activity and fault-detection;

a wire-harness;

a plurality of power-wires electrically connecting the wire-harness to the power-link portions of the two target-side connectors; and two signal-link cables connecting the host-side connector to the signal-link portions of the two target-side connectors.

18. The information transfer system of claim 17, wherein a target hard-drive is a SAS drive.

19. The information transfer system of claim 17, wherein a target hard-drive is a SATA drive.

* * * * *